US011125244B2

(12) United States Patent
Pawellek et al.

(10) Patent No.: US 11,125,244 B2
(45) Date of Patent: Sep. 21, 2021

(54) COOLANT PUMP WITH APPLICATION-OPTIMISED DESIGN

(71) Applicant: NIDEC GPM GmbH, Auengrund OT Merbelsrod (DE)

(72) Inventors: Franz Pawellek, Lautertal (DE); Conrad Nickel, Troistedt (DE); Jens Hoffmann, Schwarzbach (DE); Robin Büsch, Römhild (DE); Paul Ludwig, Erfurt (DE); Jakob Schnitzer, Hildburghausen (DE); Silvio Werner, Rödental (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 51 days.

(21) Appl. No.: 16/642,313

(22) PCT Filed: Jul. 10, 2018

(86) PCT No.: PCT/EP2018/068616
§ 371 (c)(1),
(2) Date: Feb. 26, 2020

(87) PCT Pub. No.: WO2019/042638
PCT Pub. Date: Mar. 7, 2019

(65) Prior Publication Data

US 2021/0071679 A1 Mar. 11, 2021

(30) Foreign Application Priority Data

Aug. 31, 2017 (DE) ..... 102017120039.8

(51) Int. Cl.
*F04D 29/10* (2006.01)
*F04D 13/06* (2006.01)
(Continued)

(52) U.S. Cl.
CPC ..... *F04D 29/106* (2013.01); *F01P 5/10* (2013.01); *F04D 13/06* (2013.01);
(Continued)

(58) Field of Classification Search
CPC ..... F04D 13/0673; F04D 13/064; F04D 29/5806; F04D 13/06; F04D 13/0633;
(Continued)

(56) References Cited

U.S. PATENT DOCUMENTS 3,520,642 A * 7/1970 Fulton ..... F04D 13/0633 417/420
3,933,416 A * 1/1976 Donelian ..... F04D 29/057 417/354
(Continued)

FOREIGN PATENT DOCUMENTS

CN 101059134 A 10/2007
CN 103956846 A 7/2014
(Continued)

OTHER PUBLICATIONS

International Search Report for PCT/EP2018/068616, dated Oct. 10, 2018.
(Continued)

*Primary Examiner* — Dominick L Plakkoottam
(74) *Attorney, Agent, or Firm* — Merchant & Gould P.C.

(57) ABSTRACT

An electric coolant pump is used as an auxiliary water pump in a vehicle. The pump includes radial mounting of the shaft (4) is provided by means of a coolant-lubricated radial sliding bearing (41) arranged between the pump impeller (2) and the rotor (32). A dry-running electric motor (3) with a radially inner stator (31) and a radially outer rotor (32) is accommodated in a motor chamber (13) separated from the pump chamber (10). A shaft seal (5) is between the radial sliding bearing (41) and the motor chamber (13). The rotor
(Continued)

(32) is bell-shaped with an inner surface facing the shaft seal (5) and being fixed to the shaft seal (5) to axially overlap with the shaft (4). The motor chamber (13) has an opening to the atmosphere, which is closed by a liquid-tight pressure equalization membrane (6) that is permeable to vapor.

8 Claims, 1 Drawing Sheet

(51) Int. Cl.

| | |
|---|---|
| ***F04D 29/046*** | (2006.01) |
| ***F04D 29/06*** | (2006.01) |
| ***F04D 29/42*** | (2006.01) |
| ***F04D 29/22*** | (2006.01) |
| ***F01P 5/10*** | (2006.01) |
| *F01P 3/20* | (2006.01) |

(52) U.S. Cl.
CPC ..... *F04D 13/0633* (2013.01); *F04D 29/046* (2013.01); *F04D 29/061* (2013.01); *F04D 29/22* (2013.01); *F04D 29/426* (2013.01); *F01P 3/20* (2013.01)

(58) Field of Classification Search
CPC ..... F04D 1/00; F04D 29/426; F04D 13/027; F04D 13/0606; F04D 25/06; F04D 25/062; F04D 25/0626; F04D 25/082; F04D 29/026; F04D 29/046; F04D 29/057; F04D 29/061; F04D 29/106; F04D 29/20; F04D 29/22; F04D 29/2216; F04D 29/2222; F04D 29/528; F04D 29/624; F04D 29/708; F01P 5/10; F01P 2005/125; F01P 3/20; F01P 5/12; H02K 1/2786
See application file for complete search history.

(56) References Cited

U.S. PATENT DOCUMENTS

| | | | | |
|---|---|---|---|---|
| 4,836,147 | A * | 6/1989 | Morris | F04D 13/0673 123/41.44 |
| 5,478,222 | A * | 12/1995 | Heidelberg | F04D 7/06 417/414 |
| 7,766,613 | B2 * | 8/2010 | Fukuki | F04D 13/0673 415/199.2 |
| 9,726,182 | B2 | 8/2017 | Kanazawa et al. | |
| 9,893,587 | B2 * | 2/2018 | Shi | F04D 13/0633 |
| 10,584,705 | B2 * | 3/2020 | Niu | F04D 29/2222 |
| 2004/0234389 | A1 * | 11/2004 | Hatano | F04D 13/0606 417/370 |
| 2004/0234395 | A1 * | 11/2004 | Hatano | F04D 13/064 417/420 |
| 2007/0090704 | A1 * | 4/2007 | Chen | H02K 1/2786 310/86 |
| 2008/0118380 | A1 * | 5/2008 | Nakanishi | F04D 29/5813 417/423.1 |
| 2017/0299063 | A1 * | 10/2017 | Itadani | F16C 17/02 |
| 2019/0353166 | A1 * | 11/2019 | Heitzig | F04D 29/528 |

FOREIGN PATENT DOCUMENTS

| | | | |
|---|---|---|---|
| CN | 104564791 | A | 4/2015 |
| CN | 205744104 | U | 11/2016 |
| CN | 205956069 | U | 2/2017 |
| CN | 106555765 | A | 4/2017 |
| DE | 10012663 | A1 | 9/2001 |
| DE | 10057098 | C1 | 3/2002 |
| DE | 10012662 | B4 | 11/2010 |
| DE | 102015114783 | B3 | 9/2016 |
| EP | 0846361 | A1 | 6/1998 |
| GB | 2263944 | A | 8/1993 |
| WO | 2015/011268 | A1 | 1/2015 |
| WO | 2015/121052 | A1 | 8/2015 |
| WO | 2017/036837 | A1 | 3/2017 |

OTHER PUBLICATIONS

Office Action for German Patent Application No. 102017120039.8, dated Jul. 17, 2018.
Office Action for Chinese Patent Application No. 201880055533.6, dated Apr. 8, 2021.

* cited by examiner

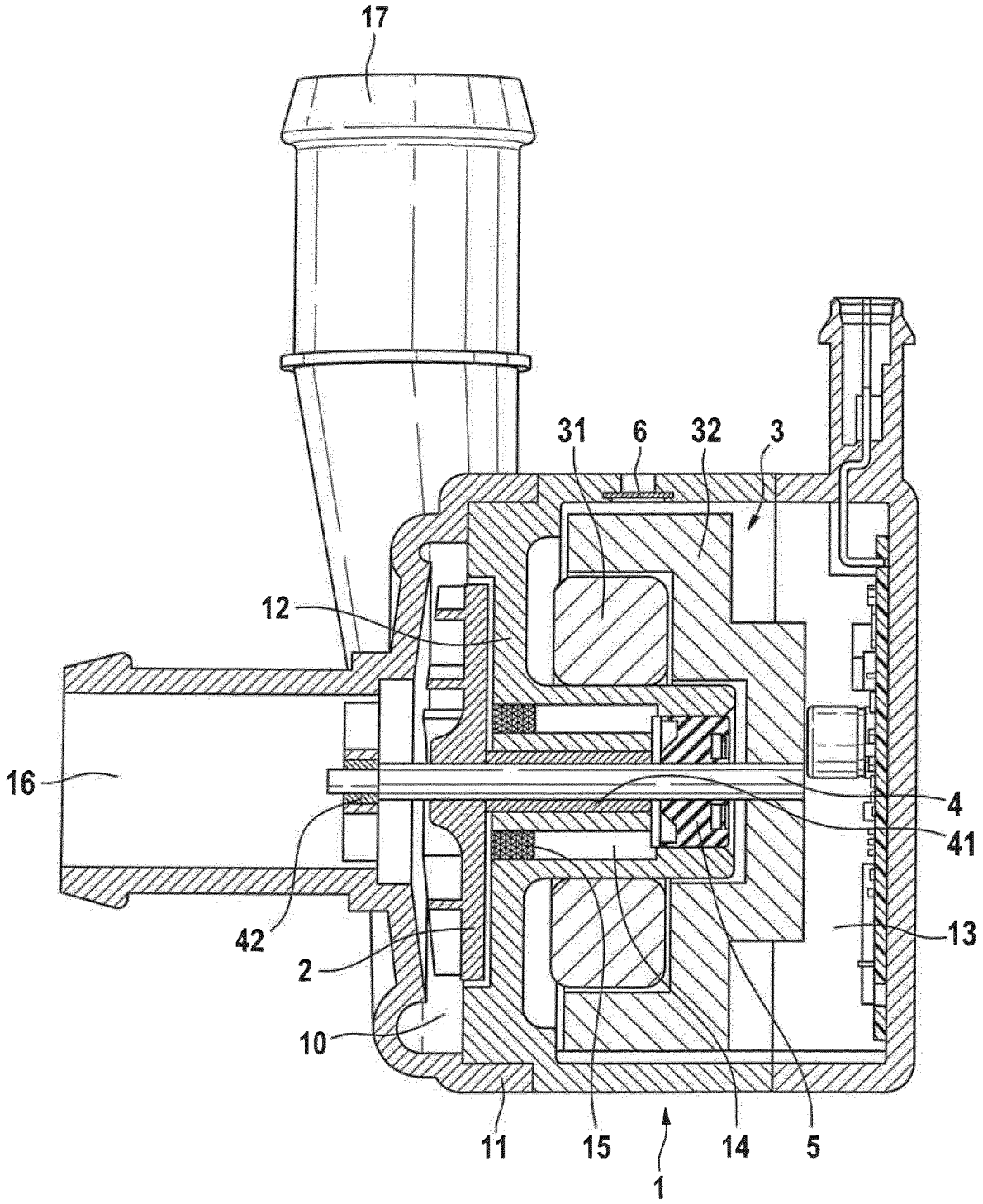
17
31
6
32
3
12
16
4
41
42
13
2
10
11
15
14
5
1

COOLANT PUMP WITH APPLICATION-OPTIMISED DESIGN

This application is a National Stage Application of PCDEP2018/068616, filed Jul. 10, 2018, which claims the benefit of German Patent Application No. 102017120039.8, filed Aug. 31, 2017, and which applications are incorporated herein by reference. To the extent appropriate, a claim of priority is made to each of the above-disclosed applications.

BACKGROUND OF THE INVENTION

The present invention relates to a coolant pump, the structure of which is optimised for the application area of auxiliary water pumps with respect to cost, assembly space and service life by means of a combination of a bearing, sealing and an electric motor.

SUMMARY OF THE INVENTION

Such electric auxiliary water pumps are used for circulating partial areas of a coolant-carrying thermal management system of a vehicle equipped with a combustion engine and a main water pump, in order to cool so-called hot spots at components of auxiliary devices, such as an exhaust gas recirculation system, a turbocharger, an intercooler or the like, more flexibly. Due to their redundancy with respect to the main water pump and the increased number of passages and intersections, this type of auxiliary water pump faces high price pressure as well as high demands with respect to a compact structural assembly with small dimensions for its integration in a complex packaging of modern thermal management systems.

In electric auxiliary water pump products established so far, wet-running electric motors with an internal rotor are used because of the simpler sealing in the relatively small pump structure, among other reasons. Using wet-running electric motors, in which, typically, the stator is sealed off from the rotor in a dry manner by means of a can or the like, and the rotor as well as a bearing are designed for being operated in a pumping medium, is a known measure in order to solve the problem of leakage at a shaft seal and failure of a shaft bearing.

However, wet-runners have a lower efficiency, since the gap between the stator and the rotor for accommodating a can is larger and a field force acting on the rotor is thus weakened. In addition, there is liquid friction at the rotor, which further reduces the efficiency, particularly of the pump drives having relatively small dimensions of auxiliary water pumps. Furthermore, problems occur at wet-runners during low temperatures, such as the formation of ice in the gap between the stator and the rotor.

In larger pumps, such as the electric main water pumps, dry-running electric motors are also used due to the better efficiency. In order to mount pump shafts driven by a dry-running electric motor, rolling bearings, such as ball bearings, are predominantly used, which receive both axial and radial loads and achieve low friction coefficients.

However, rolling bearings are generally susceptible to intruding moisture, because the materials used, particularly suitable steels of rolling elements, are not sufficiently corrosion resistant for use in moisture. Entering moisture leads to the surface finish of rolling elements and raceways being decreased due to corrosion, which results in higher friction of the bearing as well as corresponding heat generation and other consequential damage at bearings and seals. Consequently, the rolling bearings, which are costly anyway, must be provided at both end faces in pumps with yet again costly seals that ensure low-friction and reliable sealing against the occurring operating pressures in the pump chamber.

In addition to the cost disadvantage, corresponding seals always cause slight leakage and are often the limiting factor of the service life of a pump, as they are inherently subject to frictional wear and embrittlement due pressure and temperature variations.

From the patent application DE 10 2015 114 783 B3 of the same applicant, an electric coolant pump, in which the pump shaft is mounted by a single so-called water pump bearing having two rows of rolling elements between the pump impeller and the electric motor, is disclosed for use as a main water pump. In order to solve the problem of a leak entering the bearing and reaching electric components of a dry-running electric motor located behind it, a leakage chamber is provided in the pump housing between a shaft seal and the water pump bearing, in which leakage may be collected and drained without coming into contact with the water pump bearing. A leakage seal located behind it in turn prevents a collected leakage to be drained from entering into a housing section in which the motor components and electronic devices are accommodated. If a leakage from the leakage chamber were to enter directly into the housing section of the motor, water vapour generated due to the operating temperature of the motor would enter the bearing in the opposite direction from the housing section at the unsealed, unprotected side of the water pump bearing and, over time, damage said bearing.

Providing such a leakage chamber between the pump chamber and a drive has the disadvantage of additional installation space, which increases the axial dimensions of the pump structure.

Furthermore, using and installing the shaft seal and the leakage seal incurs costs that would not be accepted for auxiliary water pump products. In order to minimize the risk of the water pump bearing being damaged by intruding water vapour, using and installing another bearing seal at the unprotected side of the water pump bearing would be required.

A circulating pump for heating systems which is driven by a wet-running electric motor is known from an application in a different field from the patent application WO 2015/011268 A1. The pump shaft is mounted by a radial sliding bearing and an axial bearing provided behind it with a shaft seal. The sliding bearing is lubricated by the pumping medium supplied within the pump shaft. A rotor chamber situated axially behind is separated by a membrane with a static sealing function from a receiving space of the stator.

The disclosure does not deal with the problem of leakage at the shaft seal. A ground down membrane is mentioned as a problematic case, which leads to liquid entering the electric section of the receiving space and which is to be prevented by a filter in the lubrication supply.

Based on the problems of the mentioned state of the art to be solved, it is an object of the invention to provide a simple, cost-effective and compact pump structure for a dry-running electric motor.

Another aspect of the invention is to provide a pump structure in which a leakage chamber between a shaft seal and the dry-running electric motor may be dispensed with in favour of a shorter axial structure of the pump.

Another aspect of the invention is to provide an economic and durable alternative for mounting and sealing a shaft.

The objects are solved according to the invention by an electric coolant pump.

The electric coolant pump is particularly characterized in that a radial support of the shaft is provided by means of a coolant-lubricated radial sliding bearing disposed between the pump impeller and a rotor of a dry-running electric motor; the electric motor is accommodated with a radially inner stator and a radially outer rotor in a motor chamber separated from the pump chamber; a shaft seal is disposed between the radial sliding bearing and the motor chamber; the rotor is formed in a bell shape, the inner surface of which faces the shaft seal and is fixed therewith in an axially overlapping manner on the shaft; and the motor chamber has an opening toward the atmosphere which is closed by a liquid-tight and vapour-permeable pressure equalisation membrane.

In its most general form, the invention is based on the realization that the inventive selection, combination and arrangement of the individual components of the pump achieves a complementary chain of effects of decreasing a pressure in order to limit leakage at a shaft seal, optimal vaporization of leakage, and discharging vaporized leakage using operating conditions inside the pump, whereby the constructive and economic advantages are provided that are solution of the problem.

The invention provides, for the first time, a pressure-reduced area for a shaft seal in front of a pumping medium which is formed axially behind a sliding bearing lubricated by the pumping medium, for a dry-running electric motor. Due to a lower pressure of the pumping medium compared to a corresponding sealing surface within the pump chamber, less leakage passes through at the shaft seal.

Furthermore, the invention provides, for the first time, using a dry-running electric motor with an external rotor with a rotor cup, the inner surface of which, which is preferably closed, faces the shaft seal. Liquid drops of a leakage behind the shaft seal are thus forcibly carried through the air gap of the dry runner between the open field coils of the stator and the magnetic poles of the rotor by means of radial acceleration at the inner surface of the rotor cup, before they are able to reach a motor chamber comprising electronic devices. The drops of leakage thereby evaporate due to the operating temperature of the electric motor and a turbulent swirl inside the air gap. The generated water vapour only then reaches the motor chamber and dissipates into the atmosphere through a membrane. In this manner, an enclosure of the stator may be dispensed with and the disadvantages related thereto with respect to the efficiency of a wet-running electric motor are avoided.

Furthermore, by using a dry runner, an alternative to using costly rolling bearings and a respective sealing at both sides of the same is provided.

Consequently, the disadvantage of a limited service life of each bearing seal, which always occurs even in complex sealing types, is avoided such that a longer service life of the auxiliary water pump may be expected without failure of the shaft bearing.

At the same time, a pump structure with fewer components and economic sliding bearings is enabled by removing shaft seals and motor seals or a separating can.

Finally, a compact pump structure with small axial dimensions is achieved, in which a permanently secure operating environment for a dry runner is provided in the pump housing despite the lack of a leakage chamber.

According to an aspect of the invention, an axial support of the shaft may be provided by an axial sliding bearing disposed upstream of the pump impeller in a flow direction of the coolant.

In this way, an axial load on the shaft is received by a sliding bearing, thereby providing a simple, economic shaft bearing made exclusively of two sliding bearings lubricated by the coolant, which is in line with the object of the invention.

According to an aspect of the invention, the axial sliding bearing may be formed by a free end of the shaft and by a run-up surface on the pump housing, preferably on a pump cover.

During the operation, the pump impeller creates a thrust in the direction of the intake socket or inlet of the pump. A sliding surface of the shaft at the face and a corresponding run-up surface provide a particularly simple but sufficient axial bearing without any necessary axial fixing in the opposing direction. The structure and the installation may thus be further simplified.

According to an aspect of the invention, the shaft seal may comprise at least two sealing lips for dynamically sealing on the shaft circumference which are oriented in an effectively sealing manner toward at least one axial side.

A shaft seal with two lips provides an economic and sufficient leakage protection behind the axial sliding bearing, achieving a much better sealing compared to slip ring seals and allowing only a small accumulation of leakage drops to pass through. Sealing in the opposite direction, such as in a pump structure with a dry rolling bearing, may be dispensed with due to the wet-running sliding bearing.

According to an aspect of the invention, the pump housing may have at least one lubrication channel which connects the pump chamber to a rear end of the radial sliding bearing opposite from the pump chamber.

One or more connections of the front and rear axial ends of the sliding bearing to the pump chamber may provide not only a one-sided static impingement with pumping means until the bearing gap is filled, but a continuous circulation of pumping means in the bearing gap in order to lubricate the sliding bearing. In this way, a more regular distribution of pressure of the pumping means in the bearing gap as well as a discharge of particulates caused by abrasion of the bearing surfaces is achieved in favour of improved lubrication or lower friction.

According to an aspect of the invention, at least one filter may be assigned to the at least one lubrication channel.

If, due to the design of the flow paths, a direction of circulation is provided where the pumping medium flows first through a lubrication channel and then through the bearing gap, a filter in each lubrication channel or a filter for all lubrication channels prevents particulate impurities from reaching the bearing gap or the shaft seal. As a function of the configuration and thickness of the filter, a suitable pressure drop may be set, which results in a pressure-reduced area when compared with the pump chamber, which relieves the shaft seal and nevertheless ensures a sufficient circulation through the bearing gap.

According to an aspect of the invention, the stator of the electric motor may be disposed so as to axially overlap the at least one lubrication channel.

By arranging one or particularly several radially distributed lubrication channels adjacent to the stator of the electric motor, power dissipation of the field coils of the stator during operation is transferred to the pumping means circulating in the lubrication channels due to a heat transfer inside the pump housing and carried off to the delivery flow in the pump chamber. This advantageous effect may also be utilized at low temperature differences between a high coolant temperature and a temperature of the coil windings, which is always higher.

DESCRIPTION OF THE DRAWING

The invention is described below based on an exemplary embodiment with reference to the drawing of FIG. 1.

As may be seen in the axial sectional views in FIG. 1, a pump housing 1 includes an intake socket 16 and a pressure socket 17 illustrated on the left side, which lead into the pump chamber 10. The intake socket 16 serves as a pump inlet which is put on an open, axial end of the pump housing 10 in the shape of a separate pump cover 11 and which leads toward an end face of a pump impeller 2 fixed on a shaft 4. The circumference of the pump chamber 10 is surrounded by a spiral housing leading tangentially to a pressure socket 17 that forms a pump outlet.

The pump impeller 2 is a known radial pump impeller with a central opening adjacent to the intake socket. The delivery flow impinging on the pump impeller 2 through the intake socket 16 is accelerated by the inner vanes in a radially outward direction into the spiral housing of the pump chamber 10 and carried off.

At a side shown on the right, the pump housing 1 includes a cavity referred to as a motor chamber 13 which is separated by a partition 12 of the pump housing 1 from the pump chamber 10 and in which a brushless electric motor 3 with an external rotor is accommodated. A stator 31 with field coils of the electric motor 3 is fixed around a cylindrical section of the partition 12 of the pump housing 1 inside the motor chamber 13. The rotor 32 with permanent magnetic rotor poles is fixed rotatably around the stator 31 on the shaft 4.

An axially open end of the motor chamber 13 is closed by a motor cap of the pump housing 1, in which an electronic control unit or ECU of the pump including power-control electronics of the electric motor 3 is embedded in a manner open to the motor chamber 13. A cable bushing leading supply lines to the field coils past the rotor 32 is arranged between the power-control electronics and the stator 31 at a lower surface of the pump housing 1.

The electric motor 3 is a dry runner of which the field coils are unenclosed or open at the air gap to the rotor 32 to the motor chamber 13. The rotor 32 has a bell shape typical for an external rotor, which is seated on the free end of the shaft 4, shown on the right, and which carries the permanent magnetic rotor poles in the axial area of the stator 31. Uncharacteristically for a rotor body, the rotor 32 preferably includes no through-holes in a radially extending section, as is usually the case in order to decrease the accelerated mass at rotating carrying bodies. The bell-shaped rotor 32 thus preferably forms a closed inner side open only at the left side for receiving the stator 31.

The shaft 4 extending between the pump chamber 10 and the motor chamber 13 is radially mounted by a radial sliding bearing 41 in the cylindrical section of the division 12 of the pump housing 1. The sliding surfaces at the shaft circumference and at the bearing seat of the sliding bearing 41 are lubricated by the coolant conveyed by the auxiliary water pump, said coolant penetrating into the bearing gap between the sliding surfaces, as will be described later.

Additionally, the shaft 4 is axially mounted at the left free end. The axial sliding bearing 42 is formed by a pair of sliding surfaces between the end face of the shaft 4 and a run-up surface provided by a projection or a stay inside the intake socket 16 correspondingly positioned in front of the pump impeller 2 at the pump cover 11. During operation, the pump impeller 2 pushes the shaft 4 via a suction effect in the direction of the intake socket 16 against the run-up surface such that an axial load received by the shaft bearing in this one direction is sufficient. Because a bearing gap between the sliding surfaces is surrounded by the delivery flow, the axial sliding bearing 42 is also lubricated by the coolant, at least in the form of initial and, during vibrations or turbulences, renewed wetting of the sliding surfaces with the coolant.

A shaft seal 5 sealing an open end of the cylindrical section of the partition 12 of the pump housing 1 against the shaft 4 is arranged between the radial sliding bearing 41 and the motor chamber 13. The shaft seal 5 is a seal with two lips which is pressed into the cylindrical section of the partition 12 and which comprises two successive sealing lips (not illustrated) directed toward the radial sliding bearing 41 for one-sided dynamic sealing on the shaft circumference.

Furthermore, lubrication channels 14 are provided inside the wall of the cylindrical section of the partition 12 in the pump housing 1 which, on the one hand, open at a back surface of the pump impeller 2 into the pump chamber 10 and, on the other hand, lead to a ring-shaped cavity surrounding the shaft 4 between the rear end of the radial sliding bearing 41 and the shaft seal 5. During operation, coolant flows out of the pump chamber 10 through the lubrication channels 14 toward the shaft 4 and, delimited by the shaft seal 5, penetrates the bearing gap between the shaft circumference and the bearing seat of the radial sliding bearing 41 such that it flows back in the opposite direction. The axial circulation of the coolant, combined with the rotational motion between the sliding surfaces, ensures a regular distribution and lubrication of the bearing gap with the coolant. The coolant includes an anti-freeze agent with friction-reducing properties, e.g. a glycol, silicate or the like. At the same time, particulate caused by friction of the sliding surface pair are discharged into the pump chamber and into the delivery flow.

On the other hand, filters 15 are arranged in the area of the openings of the lubrication channels 14 to the pump chamber 10, which prevent particulate impurities, such as metal abrasion or the like, from being flushed out of the delivery flow into the bearing gap of the radial sliding bearing 41 or into the sealing gap of the shaft seal 5. When the coolant circulates through the lubrication channels 14 and the radial sliding bearing 41, a reduced pressure, compared to the pump chamber 10, acts in the radial cavity between the radial sliding bearing 41 and the shaft seal 5 due to a flow resistance of the filter 15. Although the reduced pressure set by, in addition to the configuration of the filter, the number and the flow cross-section of the lubrication channels 14, weakens the circulation through the radial sliding bearing, it also relieves the shaft seal 5, which results in a longer service life of the sealing lips due to less friction and smaller leakage.

The small, unavoidable leakage dripping out of the circulation of the lubrication channels 14 through the shaft seal 5 over time does not, however, come directly into contact with the field coils or the motor electronics in the motor chamber 13. During operation, the drops of leakage reach the inner surface of the rotating rotors 32 behind the shaft seal 5 and are carried out radially by centrifugal force. Due to turbulence at the rotor poles or permanent magnets and due to the operating temperature resulting from the power dissipation at the field coils, the drops of leakage vaporize in the air gap between the stator 31 and the rotor 32 without being able to moisten the radially inner stator 32 in a liquid phase, i.e., without being able to exert a corrosive effect.

Due to the closed bell shape of the rotor 32, the drops of leakage may not reach the motor chamber 13 and the electronic devices in an axial direction but are instead intercepted at the inner surface of the rotor 32 and supplied to the air gap for vaporization. In order to keep a volume of the air gap low, it is shaped in a complementary manner and staggered toward the circumference of the cylindrical section of the division 12 and the stator 32.

When the drops of leakage transit from the liquid phase to the gaseous phase, their volume increases, which, if the volume of the motor chamber 13 were closed, would lead to a pressure increase independent of a pressure fluctuation, which would be caused by temperature fluctuations between operation and an idle state of the pump.

However, a membrane 6 is provided between the motor chamber 13 and the surrounding atmosphere, which enables compensation of pressure fluctuations from the motor chamber 13 to the atmosphere. The membrane 6 is semi-permeable with respect to a water permeability, i.e., it does not allow water in a liquid phase to pass, while air carrying moisture may diffuse through it up to a limit with respect to the size of the droplets or a density of droplets agglomerating at the membrane surface. When a volume expands due to vaporization inside the motor chamber 13, warm air carrying moisture may pass through the membrane 6 such that vaporized drops of leakage are effectively carried out into the atmosphere. In the opposite direction, the membrane 6 in turn protects against splash water or the like entering during operation of the vehicle.

The membrane 6 closes an opening of the pump housing 1 which is arranged at the top in an area of an exit of the air gap between the stator 31 and the rotor 32. Furthermore, a plug for an external power supply is arranged at the top surface of the pump housing 1.

In addition to the illustrated and described embodiment, the invention may also be implemented with alterative developments having additional features or omitting described features. As may be seen from the explanations regarding the solution of the problem, the pump may also be implemented without lubrication channels 14 and the filter 15, or with a different axial bearing than the sliding bearing 42 in the area of the intake socket 16, or with a different shaft seal 5 than the one with two sealing lips. In a case in which no lubrication channels 14 are provided, at least a static lubrication of the bearing gap of the radial sliding bearing 41, which may be set via the bearing gap, may be utilized via the operating pressure from the pump chamber 10, a decreased pressure compared to the pump chamber 10 once again acting on the shaft seal 5 behind the radial sliding bearing 41.

The invention claimed is:

1. An electrical coolant pump for conveying coolant in a vehicle, comprising:

a pump housing with a pump chamber in which a pump impeller is rotatably received, an inlet and an outlet which are connected to the pump chamber;

a shaft rotatably mounted on the pump housing, wherein the pump impeller is fixed to the shaft;

a coolant-lubricated radial sliding bearing disposed between the pump impeller and a radially outer rotor providing a radial support of the shaft; a dry-running electric motor with a radially inner stator and the radially outer rotor is received in a motor chamber, the motor chamber being separated from the pump chamber;

a shaft seal disposed between the radial sliding bearing and the motor chamber;

wherein the rotor is formed in a bell shape, the inner surface of the rotor faces the shaft seal and is fixed with the shaft seal in an axially overlapping manner on the shaft; and the motor chamber has an opening toward atmosphere which is closed by a liquid-tight and vapour-permeable pressure equalisation membrane.

2. The electrical coolant pump according to claim 1, wherein an axial support of the shaft is provided by an axial sliding bearing disposed upstream of the pump impeller in a flow direction of the coolant.

3. The electrical coolant pump according to claim 1, wherein an axial sliding bearing is formed by a free end of the shaft and by a run-up surface on the pump housing, on a pump cover.

4. The electrical coolant pump according to claim 1, wherein the shaft seal has at least two sealing lips for dynamic sealing on the shaft circumference which are oriented in a sealing manner toward at least one axial side.

5. The electrical coolant pump according to claim 1, wherein the pump housing has at least one lubrication channel which connects the pump chamber to a rear end of the radial sliding bearing opposite from the pump chamber.

6. The electrical coolant pump according to claim 5, wherein the at least one lubrication channel includes at least one filter.

7. The electrical coolant pump according to claim 1, wherein the stator of the electric motor is disposed to axially overlap the at least one lubrication channel.

8. A method of operating an electrical coolant pump according to claim 1, comprising operating the electrical coolant pump as an auxiliary water pump in a coolant-carrying system in a vehicle with an internal combustion engine and a main water pump.

* * * * *